United States Patent [19]

Warnock

[11] 4,332,058

[45] Jun. 1, 1982

[54] WEB DOFFING APPARATUS

[75] Inventor: William A. Warnock, Lyman, S.C.

[73] Assignee: John D. Hollingsworth on Wheels, Inc., Greenville, S.C.

[21] Appl. No.: 144,597

[22] Filed: Apr. 28, 1980

[51] Int. Cl.[3] ..... D01G 15/46

[52] U.S. Cl. ..... 19/106 R

[58] Field of Search ..... 19/106 R; 118/261

[56] References Cited

U.S. PATENT DOCUMENTS 3,283,366 11/1966 Kalwaites ..... 19/161.1
3,400,430 9/1968 Kalwaites ..... 19/106 R
3,711,888 1/1973 Dunlap ..... 118/261 X
4,017,942 4/1977 Clayton et al. ..... 19/106 R

FOREIGN PATENT DOCUMENTS 751965 7/1956 United Kingdom ..... 19/106 R

*Primary Examiner*—Louis Rimrodt
*Attorney, Agent, or Firm*—Bailey & Hardaway

[57] ABSTRACT

A web doffing apparatus of the type wherein a driven roll forms, together with a tangential blade, an entrance opening for a carded web. A blade support is illustrated which may be pivoted to a position facilitating removal of the blade for servicing and for return to improved operation.

4 Claims, 3 Drawing Figures

WEB DOFFING APPARATUS

BACKGROUND OF THE INVENTION

According to the prior art, the blade is fastened in an elongated slot within a mounting bar through the use of wedges, shims, set screws and the like. It is also common practice to carry accessories such as static bars and the like upon the blades. The blade mounting bar is carried within a stand or frame member and is often spring biased to urge the blade into tangential engagement with the rotatable roll through the use of coil tension springs positioned adjacent each end thereof. Problems are occasioned through the use of such apparatus in that considerable time, often on the order of one-half hour per shift, is required to remove the blade and attached accessories for cleaning of the blade. Moreover, the blade has a substantial unsupported length such as to be less conducive than is possible herein to the production of a uniform fibrous web. The parts are expensive since considerable milling is necessary in order to provide parts which fit according to necessary tolerances.

Accordingly, it is an important object of this invention to provide a blade holding apparatus which will permit rapid removal of the blades for cleaning and which will carry the blade independently of accessories such as the static bar.

A further object of the invention is to provide a support which positions the blade by the mere act of insertion of the blade, with an edge portion and an intermediate portion of the blade supported such that a substantial free portion of the blade is held in cantilevered relationship causing substantially uniform force to be exerted across the blade at the point of tangency to produce an improved web.

This is an improvement relating to devices such as illustrated in U.S. Pat. No. 3,283,366.

SUMMARY OF THE INVENTION

It has been found that a blade support may be provided for use in doffing apparatus wherein a substantial portion of the blade may be received by a blade holder in such a way as to attach the blade adjacent one edge and exert a linear force across a middle portion of the blade urging the free edge of the blade into tangential contact uniformly along the rotatable roll in such a fashion that the blade holder may be pivoted or otherwise moved aside for easy removal of the blade for servicing.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is an end elevation similar to FIG. 1 illustrating the blade support mechanism pivoted to one side for easy removal of the blade and for subsequent replacement of the blade preparatory to being again positioned in predetermined aligned relation with the rotatable roll.

DESCRIPTION OF A PREFERRED EMBODIMENT

The drawings illustrate apparatus for removing a fibrous web from a rotatable web carrying member utilizing a rotatable roll adjacent the member and a flexible blade in tangential contact with the roll forming an entrance opening for the web adjacent a free end of the blade. A blade support includes an elongated substantially channel-shaped member having an elongated support or base member A. Means B releasably mount the channel-shaped member opening toward the rotatable roll in predetermined aligned relation therewith. Means C are carried adjacent one edge of the base remote from the roll into which a portion of the blade opposite the free end may be inserted and removably retained. A projecting portion D is carried adjacent the other edge of the base of the channel shaped member urging the blade into resilient engagement with the roll. Thus, the channel-shaped member may be released from such aligned relation with the roll to facilitate removal of the blade for cleaning and the like.

Figure 1:
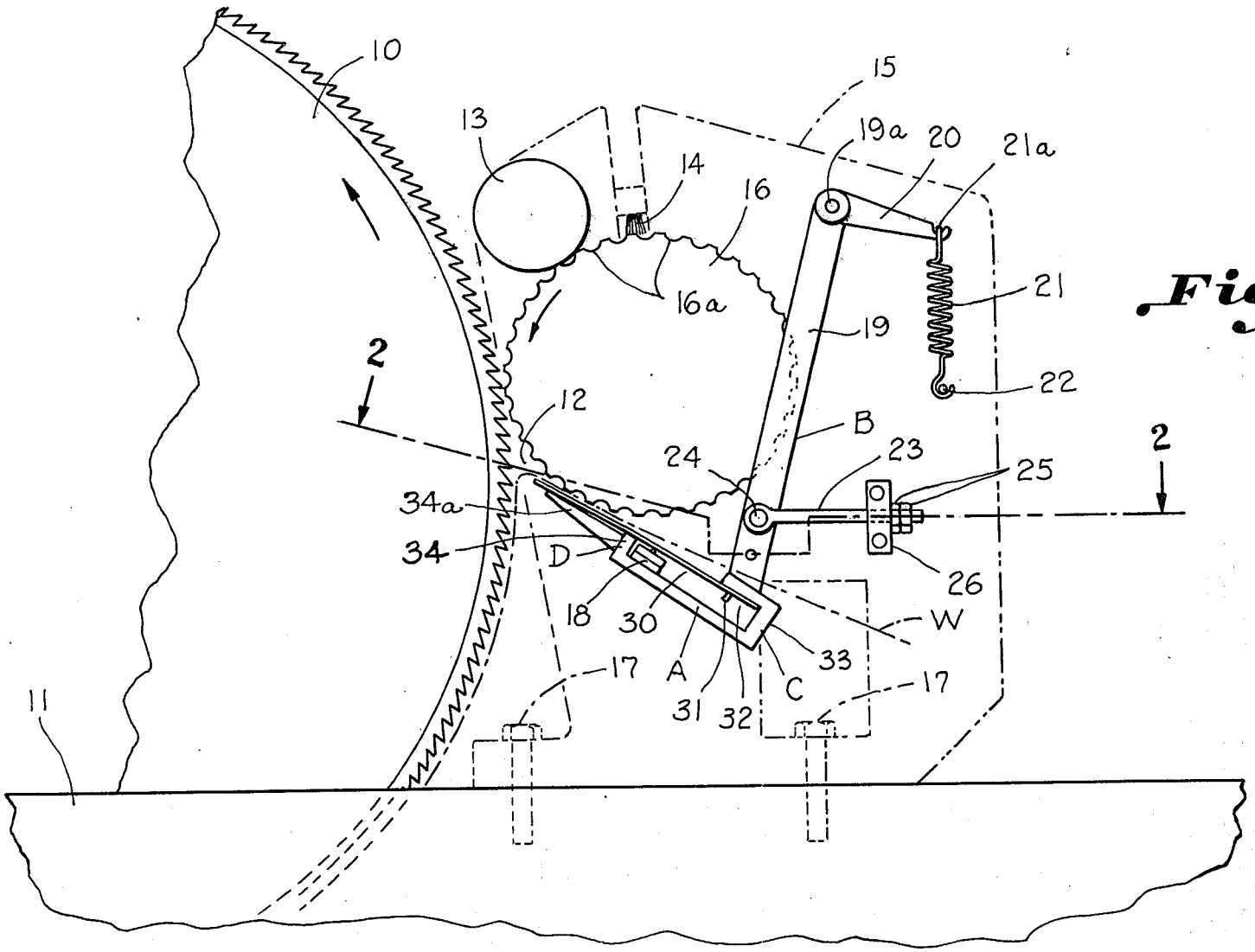
FIG. 1 is a schematic side elevation illustrating doffing apparatus constructed in accordance with the present invention in operation adjacent a doffer of a card.

Referring more particularly to FIG. 1, a clothed doffer roll of a suitable carding apparatus is illustrated at 10. The doffer is carried within frames 11 of the carding apparatus. The path of the web W is illustrated in broken lines in FIG. 1 as passing into the entrance opening 12 defined by the blade and the rotatable fluted roll. A scavenger roll 13 is schematically designated in FIG. 1 as is a brush 14 which is carried between suitable frame supports 15 illustrated in broken lines. The scavenger roll removes excess lint and fibrous material, whereas the brush 14 keeps the fluted roll clean.

The fluted roll is designated at 16 and carries spaced fluted indentations illustrated at 16*a*. The fluted roll 16 has suitable rotatable mounting between the frame members 15 and is driven in the direction of the arrows in the drawings. The frame members are illustrated as being secured by suitable bolts 17 to the frame members of the card. The base A of the channel-shaped member receives thereupon a static bar or similar member 18 for removing static from the web in conventional fashion. It is significant that the static bar, however, is carried by the channel-shaped member rather than being positioned upon the blade. The channel-shaped member is illustrated as being fixed adjacent one end of the means B for releasably mounting same. The means B for releasably mounting the channel-shaped member includes an elongated link 19 which has an arm 20 projecting from an upper portion thereof for being urged downwardly by the springs 21 which have connection as at 22 with the adjacent side frame member 15. The spring 21 has connection at the other end as at 21*a* with the arm 20. An elongated shank member 23 has pivotal connection at 24 with an intermediate portion of the arm 19 and carries lock nuts 25 on a threadable portion of the opposite end which serve to limit movement of the shank 23 to the left in FIG. 1 because of engagement thereby with a bracket portion 26 carried by frame members 15. The linkage arms 19 and 20 are pivoted adjacent their juncture as at 19*a* to the respective side frame members 15.

Figure 2:
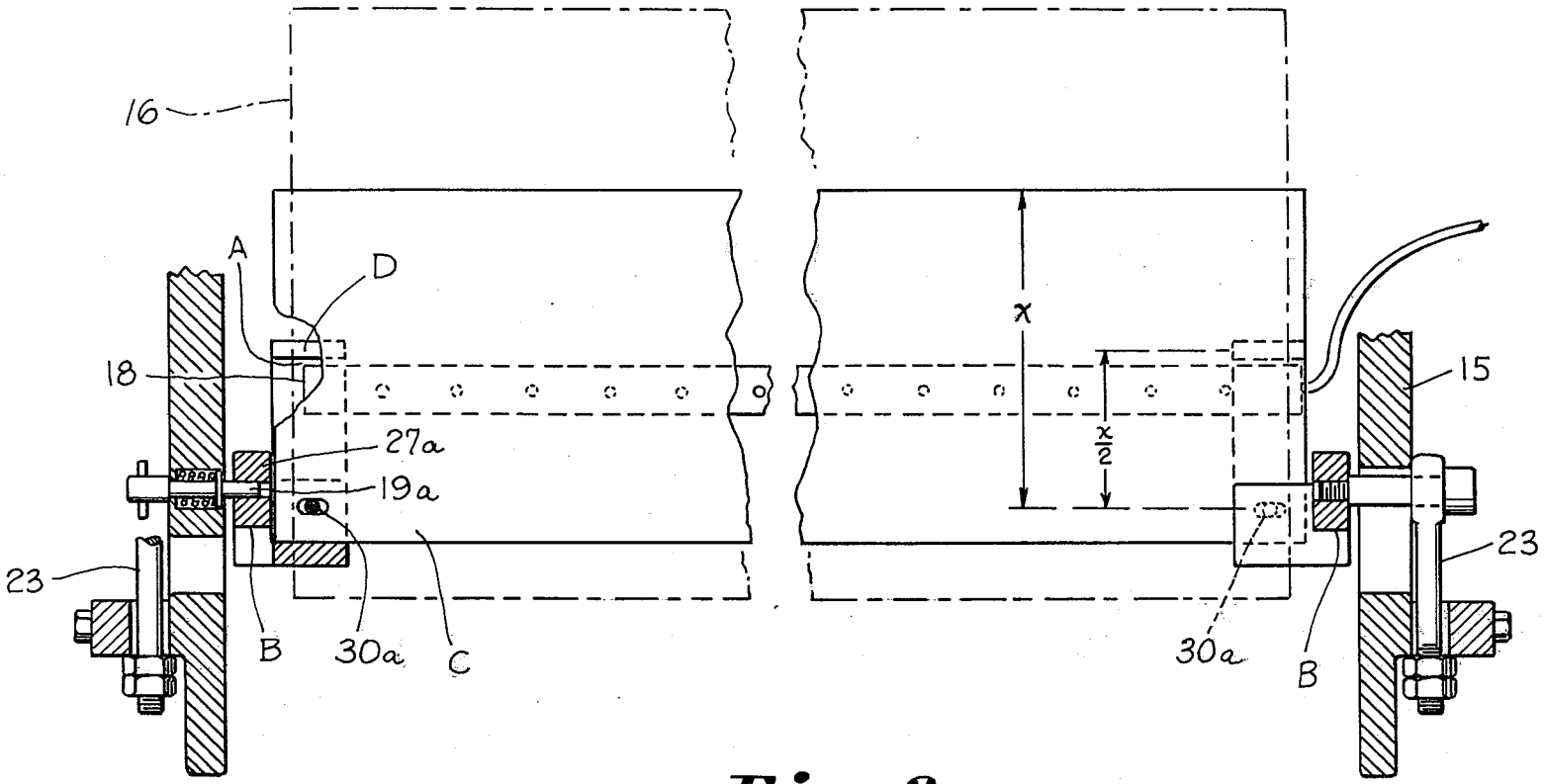
FIG. 2 is a sectional plan view taken substantially along the line 2—2 in FIG. 1.
Figure 5:
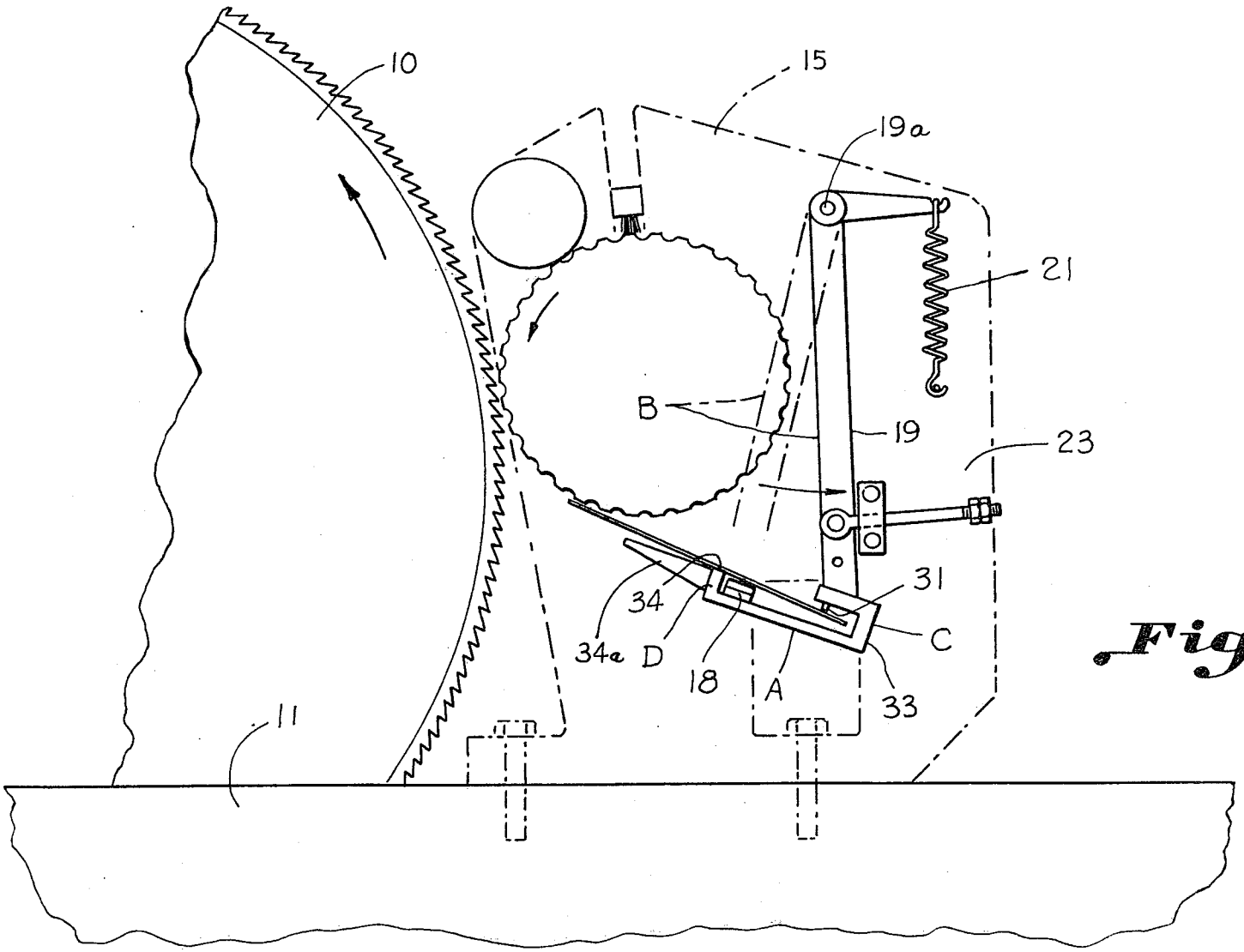

It should be noted in FIG. 2 that detent means 27 which includes a plunger portion 27*a* is receivable within an opening 19*a* within the arm 19 for fixing the position of the blade holder in predetermined aligned relation with the rotatable roll 16. The blade 30 has slots 30*a* adjacent each end thereof for receiving spaced studs 31 which project inwardly toward the base member A from an inwardly projecting flange 32 carried by a free upper edge of an upwardly projecting flange 33. The blade extends upwardly over an upper edge of a flange 34 prior to being resiliently received in tangential contact with the rotatable roll 16. The member 34 may have an extension 34*a* which is undercut to have a spaced relation with the blade when in normal operation. Should a choke and the like pass into the throat defined by the blade, the blade will be depressed so as to engage the extension 34*a* to move the entire blade support out of the way by pivoting the arm 19 about the pivot point 19*a* to avoid damage.

It will be noted that the blade is the only fixed mass in the system as it relates to the spaced flutes of the driven roll, and that it is urged along a transverse line approximating the medial portion thereof into engagement therewith. It has been found that the resonant frequency of such a blade is increased with better stripping ability.

While a preferred embodiment of the invention has been described using specific terms, such description is for illustrative purposes only, and it is to be understood that changes and variations may be made without departing from the spirit or scope of the following claims.

What is claimed is:

1. An apparatus for removing a fibrous web from a rotatable web carrying member utilizing a rotatable roll adjacent said member and a flexible blade in tangential contact with said roll forming an entrance opening for the web adjacent a free end of the blade, a blade support comprising:

an elongated support member;

pivoted linkage means releasably mounting said support member in predetermined aligned relation with said rotatable roll;

receiving means carried adjacent one edge of said support member remote from said roll into which a portion of said blade opposite said free end may be inserted and removably retained;

a projecting portion carried adjacent the other edge of said support member urging said blade into resilient engagement with said roll;

resilient means urging said linkage means toward said predetermined position, and stop means retaining said linkage means in said predetermined position against the action of said resilient means;

whereby said support member may be released from said aligned relation with said roll to facilitate removal of said blade for servicing.

2. The structure set forth in claim 1 wherein said elongated support member, said receiving means and said projecting portion form a substantially channel-shaped member opening toward said rotatable roll.

3. The structure set forth in claim 2 including an overlying member receiving a base edge of said blade, said projecting portion exerting a linear force adjacent a medial portion of said blade.

4. The structure set forth in claim 2 including a static bar carried in said channel-shaped member beneath said blade.

* * * * *